United States Patent [19]

Leikert et al.

[11] Patent Number: 4,790,743

[45] Date of Patent: Dec. 13, 1988

[54] METHOD OF REDUCING THE NOX-EMISSIONS DURING COMBUSTION OF NITROGEN-CONTAINING FUELS

[75] Inventors: Klaus Leikert; Klaus-Dieter Rennert; Gerhard Büttner, all of Gummersbach, Fed. Rep. of Germany

[73] Assignee: L. & C. Steinmüller GmbH, Gummersbach, Fed. Rep. of Germany

[21] Appl. No.: 937,346

[22] Filed: Dec. 3, 1986

Related U.S. Application Data

[63] Continuation-in-part of Ser. No. 645,030, Aug. 28, 1984, abandoned.

[30] Foreign Application Priority Data

Sep. 5, 1983 [DE] Fed. Rep. of Germany ..... 3331989

[51] Int. Cl.[4] ..... F23C 5/00

[52] U.S. Cl. ..... 431/8; 431/4; 110/261; 110/186; 110/265

[58] Field of Search ..... 431/8, 4; 110/186, 261, 110/263, 265

[56] References Cited

U.S. PATENT DOCUMENTS

| | | | |
|---|---|---|---|
| 4,057,021 | 11/1977 | Schoppe | 431/2 X |
| 4,089,628 | 5/1978 | Blackburn | 431/6 |
| 4,117,075 | 9/1978 | Sano | 431/2 X |
| 4,480,559 | 11/1984 | Blaskowski | 431/2 X |

FOREIGN PATENT DOCUMENTS

| | | |
|---|---|---|
| 102006 | 6/1983 | Japan . |
| 2050594 | 1/1961 | United Kingdom . |

*Primary Examiner*—Larry Jones

*Attorney, Agent, or Firm*—Becker & Becker, Inc.

[57] ABSTRACT

A method of reducing the $NO_x$—emissions during combustion of nitrogen-containing fuels via burner units each including a primary burner and being arranged in a wall of a closed combustion chamber; fuel and air for combustion are supplied to the burner flame in stages as partial flows via delivery means which are separate from one another. With a number of primary burners being arranged one above the other the method is carried out in three steps: feeding coal dust along with its carrier gas to the primary burner and generating a primary flame zone having a strong internal back flow region and burning the coal dust under fuel-rich conditions, feeding reduction fuel into the combustion chamber and generating a secondary flame zone in the vicinity of the primary flame zone and being operated under more-fuel-rich conditions than the primary flame zone, feeding reduction fuel into the combustion chamber and generating a secondary flame zone in the vicinity of the primary flame zone and being operated under more-fuel-rich conditions than the primary flame zone, and feeding state air into the combustion chamber of the secondary flame zone and being operated under fuel lean conditions.

9 Claims, 3 Drawing Sheets

METHOD OF REDUCING THE NOX-EMISSIONS DURING COMBUSTION OF NITROGEN-CONTAINING FUELS

This is a continuation-in-part of copending parent application Ser. No. 645,030-Leikert et al., filed Aug. 28, 1984, now abandoned.

BACKGROUND OF THE INVENTION

The present invention relates to a method of reducing the $NO_x$-emissions during combustion of nitrogen-containing fuels via burners in a closed combustion chamber; fuel and air for combustion are supplied to the burner flame in stages as partial flows via delivery means which are separate from one another.

The reaction modes which cause the formation of nitrogen oxides in industrial firing equipment are largely known.

A method of the above mentioned type is known from the U.S. Pat. No. 4,395,223. In FIGS. 9 and 10 of this Patent Letter a large-sized box furnace is shown, in the one vertical wall of which a row of primary burners for burnung a liquid fuel together with combustion air injected around the liquid fuel in a primary flame zone without internal back flow at a rate in excess of the stoichiometric rate required for the combustion of the liquid fuel is provided, i.e. the fuel is burnt in a first stage combustion zone under fuel lean conditions. In the wall above the row of primary burners there is arranged a row of secondary or reduction fuel nozzles or burners, namely two secondary fuel nozzles for each primary burner, which lead to the generation of a second stage combustion zone operated under fuel rich conditions.

Downstream the reduction fuel nozzles there is provided a row of air nozzles for generating a third stage combustion zone downstream the secondary flame zone supplied with stage air at a rate not less than the stoichiometric rate required for the final burn out of the unburnt component. In case of the shown box furnace the reduction fuel is injected toward a location downstream of the combustion gas of the primary flame zone and in the specification it is also mentioned that the reduction fuel might be injected around the primary flame zone.

In another known method (FIG. 5 of U.S. Pat. No. 4,4O3,941) there is provided a combination of a primary burner with a secondary burner or reduction fuel supply in at least two stages so that a primary flame zone and a secondary flame zone are repeatedly formed in the direction of the upward gas stream in the furnace, but independant from the number of stages upstream there is only one final combustion zone generated downstream.

Since there is only one final combustion zone for a plurality of primary and secondary burner combinations the $NO_x$-emission control under load variations is less effective, especially if one row of primary burners and associated reduction fuel supplies are shut off and partial load of the combustion process. Further, in the area of primary and secondary flame zones repeatedly formed along the wall, there is a oxygen-lean atmosphere leading to corrosion of the wall and slagging on the wall.

It is an object of the present invention, when burning nitrogen-containing coal dust via a plurality of primary burners one arranged above the other, to secure sufficient reduction of $NO_x$-emission under varying load conditions.

It is another object to keep the oxygen-lean areas along the wall as small as possible.

SUMMARY OF THE INVENTION

The method for the reduction of the $NO_x$-emission during the combustion of nitrogen-containing fuels via a plurality of burner units each including a primary burner and being arranged preferably vertically in a wall of a closed combustion chamber, the method including the step of supplying fuel and combustion air in stages to the burner flames via supply lines, which are separate from each other and open into the wall in a substantially vertical arrangement, the improvement in combination therewith comprises with a number of said primary burners one arranged above the other the steps of:

feeding coal dust along with its carrier gas to the primary burner and generating a primary flame zone having a strong internal back flow region and burning the coal dust under fuel-rich conditions, feeding reduction fuel into the combustion chamber and generating a secondary flame zone in the vicinity of the primary flame zone and being operated under more-fuel-rich conditions than the primary flame zone, and feeding stage air into the combustion chamber and generating a final combustion zone in the vicinity of the secondary flame zone and being operated under fuel lean conditions.

By providing an internal back flow region it is possible to ignite in a stable manner the coal dust being used as primary fuel under varying load conditions.

Since with each burner unit there is generated a final combustion zone it is possible to shut down one or more of the primary burners of the number of burner units arranged one above the other under varying load conditions without effecting the $NO_x$-control of the other burner units. The injection of stage air with each primary burner produces a closed flame shape with which the contact of oxygen-lean flame zones with the wall of the combustion chamber is avoided.

With the primary burners being supplied with coal dust it is of advantage to also use coal dust along with its carrier gas as reduction fuel. In doing so it is of further advantage that coal dust different in its reactivity from the primary coal dust is used. Such coal dust may be generated by using the same raw coal as for the primary burners, but milling it to a finer dust, or by using a different raw coal for the reduction fuel having the same degree of milling fineness but another chemical composition.

On the other side it is possible to use as reduction fuel a burnable gas or a fuel oil, because these fuels have a per se higher reactivity than coal dust.

The carrier gas for the primary coal dust and/or the reduction coal dust is selected from the group: air, flue gas of the combustion or mixtures thereof.

When performing the method it is preferred that the air to fuel ratio in the primary flame zone is in the range of 0.65–0.9 in the secondary flame zone is in the range of 0.5–0.8 and in the final combustion zone in the range of 1.05–1.4, preferably 1.1–1.3.

BRIEF DESCRIPTION OF THE DRAWINGS

The object and other objects and advantages of the present invention, will appear more clearly from the following specification in conjunction with the accompanying drawing.

DESCRIPTION OF THE PREFERRED EMBODIMENTS

Figure 1:
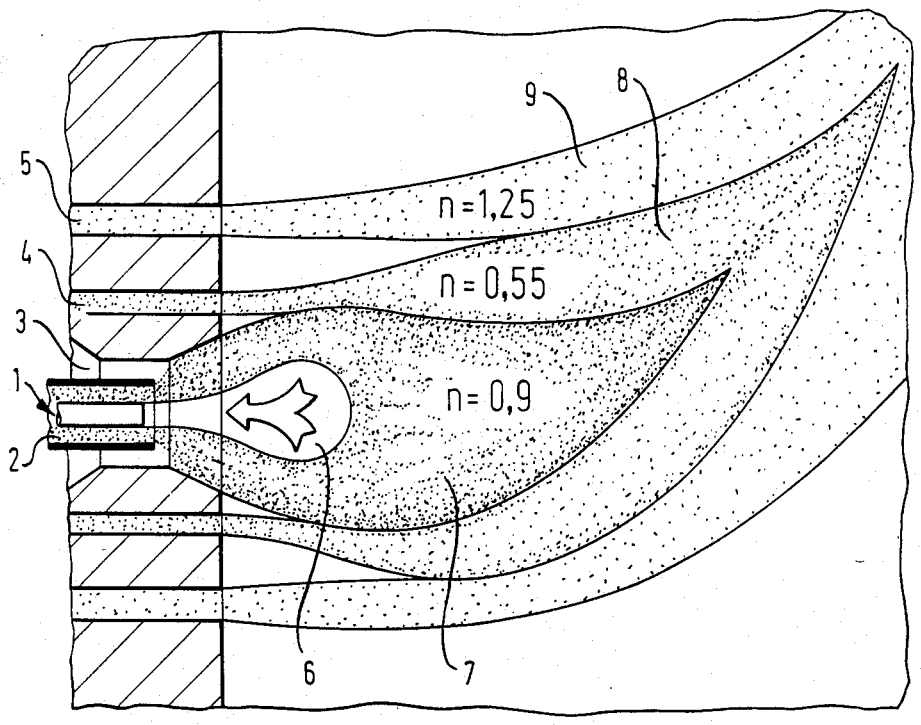
FIG. 1 is a principle vertical section through the wall of a combustion furnace to show the three flame zones.

Referring now to FIG. 1 in detail coal dust along with its carrier air is injected as primary fuel through the cross-sectional area 2 of the primary burner 1. Mantle air is supplied through an outer cross-sectional area 3, which is disposed coaxially to the cross-sectional area 2. This supply of coal dust and air forms a primary flame zone 7, which operates under fuel-rich conditions, i.e. the ratio of air to fuel in the primary flame zone is less than 1. The primary flame has a high ignition stability as a result of the reliance on the air and fuel supply and of the fact that the ignition is enforced by the presence of a powerful internal back flow region 6. The internal back-flow is due to the fact that the mantle air is twisted and the cross-sectional area 3 is flared towards the combustion chamber. The back flow zone 6 is formed independently of any adjacent burner arranged above, below or by the side of the primary burner 1.

Reduction fuel is injected around the primary flame zone 7 via reduction fuel nozzles 4, which are disposed around the periphery of the primary burner, so that a secondary flame zone 8 is formed in the vicinity and around the primary flame zone.

Since a burner flame tends to form in an upwardly bent configuration as shown in FIG. 1 it may be sufficient that the secondary fuel is supplied only via one or more nozzles 4 arranged above the primary burner 1. The secondary flame zone is operated under a more fuel-rich condition, so that it provides a reducing atmosphere reducing the $NO_x$ produced in the primary flame zone 7.

Stage air is supplied by stage air nozzles 5 to generate a final burn out zone 9. With FIG. 1 the stage air is injected so as to generate the final burn out zone around the secondary flame zone 8. As it might be the case with the reduction fuel injection it might be sufficient to inject the stage air only by one or more nozzles 5 provided in the wall of the combustion chamber above the primary burner 1. It is, however, of importance for the present invention that at least one nozzle 5 is directly associated to the combination of primary burner 1 and reduction fuel nozzles 4. (It might be sufficient to use only one reduction fuel nozzle 4; but it is preferred to use a plurality of nozzles 4 and a plurality of nozzles 5 to distribute reduction fuel and stage air, respectively substantially uniformly over the cross-section of the combustion chamber.) The final burn out zone 9 is operated under fuel lean conditions.

In FIG. 1 the air to fuel ratios of $n=0.9$ for primary flame zone 7, $n=0.55$ for secondary flame zone 8 and $n=1.25$ for final burn out zone 9 lie within the preferred ranges.

In the present specification and claims the ratio of air to fuel abbreviated herein to n is equal to a ratio of the actual quantity of air to the quantity of air theoretically neccessary for the combustion of the fuel at hand, i.e. for a n equal 1 the actual quantitiy of air corresponds to the quantity of air theoretically neccessary for the combustion of the fuel at hand, whereas n smaller than 1 means that the actual quantity is smaller than the theoretically neccessary quantity.

Figure 2:
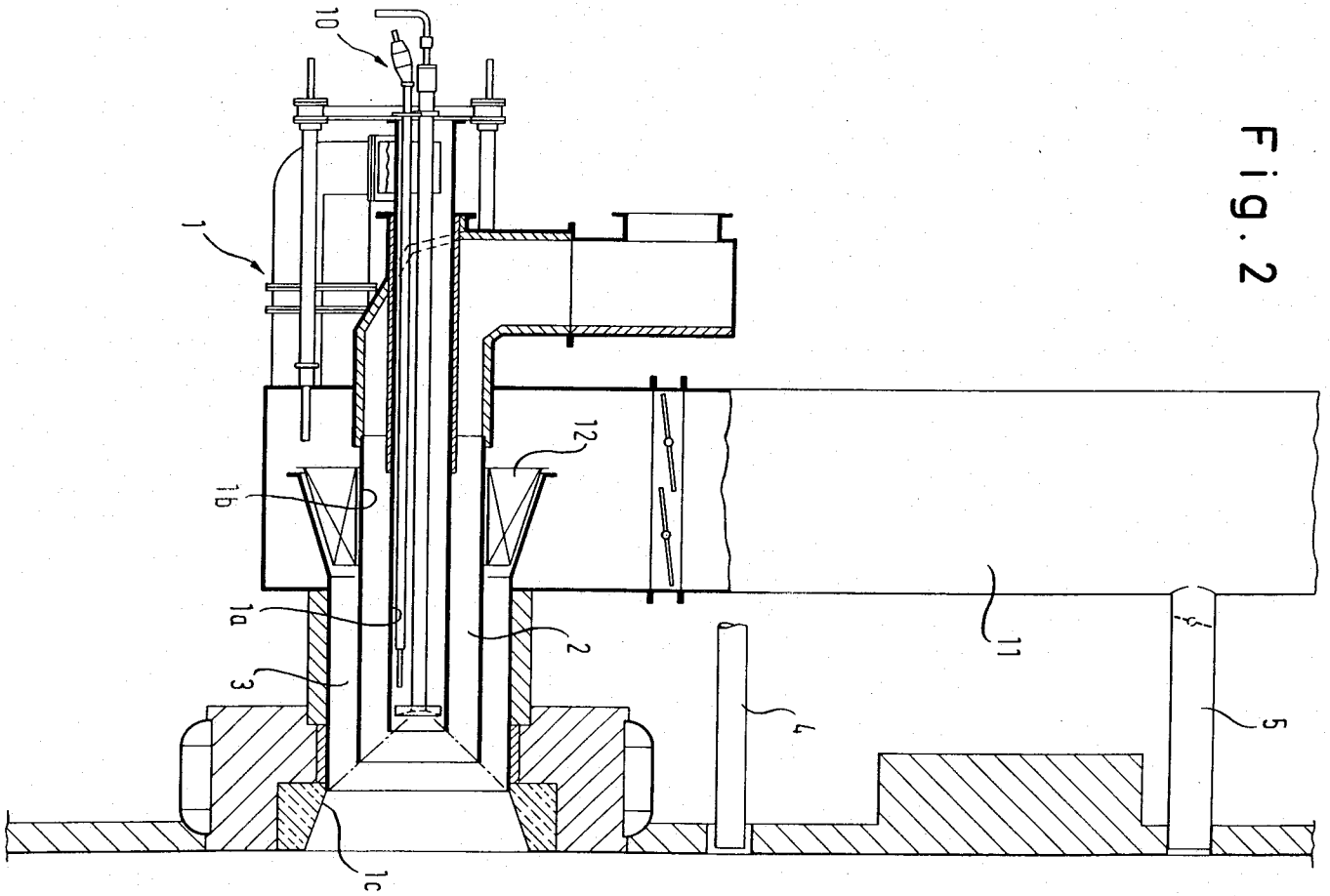
FIG. 2 is a vertical section through one embodiment of a burner unit and FIG. 3 is a plain view from the inside of a closed combustion chamber on one wall thereof showing two vertical rows of burner units arranged side by side in a vertical wall of the combustion chamber.
Figure 3:
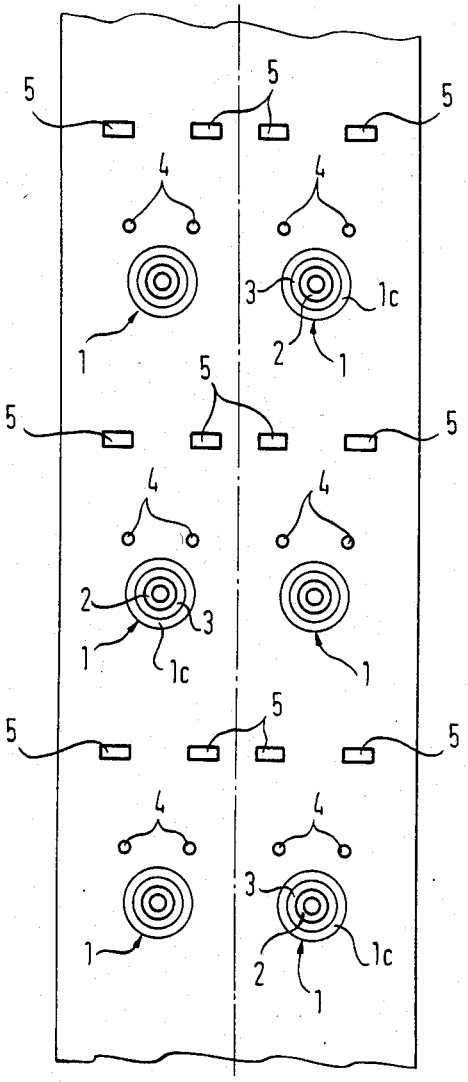

With FIGS. 2 and 3 the same reference numbers are used as in FIG. 1.

In the primary burner 1 the cross-sectional area 2 is delimited by a center tube 1*a*, in which the oil electric ignition unit 10 is arranged and which is connected to the air supply 11, so that so called core air may be fed through the tube 1*a* in case of need, especially for cooling unit 10. Further the primary burner 1 includes a tube 1*b* being the limit between the cross-sectional areas 2 and 3. At the entrance of cross-sectional area 3 from the air supply 11 there is arranged an adjustable swirling apparatus 12 introducing a swirl to the air flowing into the cross-sectional area 2. Further the primary burner has a flared mouth 1*c* in the wall opening toward the combustion chamber. It is well known in the art that an internal back-flow region can be provided by imparting a swirl to the mantle air 3 and/or by the widening 1*c* of the burner mouth. Reference is made for example to the U.S. Pat. Nos. 4,466,363 and 4,331,638, in the latter of which the same arrow symbol is used as in FIG. 1 of the present application.

With the embodiment shown in FIGS. 2 and 3 there are provided above each primary burner 1 two reduction fuel nozzles 4 of circular cross-section and two stage air nozzles 5 of square cross-section arranged side-by-side, respectively. In contrast to the prior art method, however, for each primary burner the nozzles 4 and 5 are provided.

The stage air injected through nozzles 5 can be withdrawn from the main air supply 11 supplying the mantle air 3 and the core air as shown in FIG. 2, but can, however, be withdrawn from a separate supply for all the six burner units shown in FIG. 3.

In case of load variations it is possible to stop the supply of primary and secondary fuel to anyone of the plurality of burner units shown in FIG. 3, while keeping the most effective $NO_x$-emission control with the still operating burner units. With the prior art method there was only the uppermost line of air nozzles or after burners.

What we claim is:

1. A method for the reduction of the $NO_x$-emission during the combustion of nitrogen-containing fuels via a plurality of burner units each including a primary burner and being arranged preferably vertically in a wall of a closed combustion chamber, the method including the step of supplying fuel and combustion air in stages to the burner flames via supply lines, which are separate from each other and open into the wall in a substantially vertical arrangement, the improvement in combination therewith comprises with a number of said primary burners one arranged above the other the steps of:

feeding coal dust along with its carrier gas, and a stream of mantle air, to the primary burner and generating a primary flame zone having a strong internal back flow region and burning the coal dust under fuel-rich conditions, feeding reduction fuel into the combustion chamber and generating a secondary flame zone in the vicinity of the primary flame zone and being operated under more-fuel-rich conditions than the primary flame zone, and feeding stage air into the combustion chamber and generating a final combustion zone in the vicinity of the secondary flame zone and being operated under fuel lean conditions.

2. A method according to claim 1, wherein coal dust long with its carrier gas is used as reduction fuel.

3. A method according to claim 2, wherein coal dust different in its reactivity from the primary coal dust is used.

4. A method according to claim 1, wherein a burnable gas or a fuel oil is used.

5. A method according to claim 1, wherein the fuel air to fuel ratio in the primary flame zone is in the range of 0.65–0.9, in the secondary flame zone is in the range of 0.5–0.8 and in the final combustion zone in the range of 1.05–1.4.

6. A method according to claim 1, wherein the reduction fuel and the stage air are at least introduced via a plurality of nozzles, the nozzles of each plurality being arranged side-by-side and above the primary burner.

7. A method according to claim 1, wherein the primary flame zone generates at least half the total thermal output of the burner unit.

8. A method for the reduction of the $NO_x$-emission during the combustion of nitrogen-containing fuels via a plurality of burner units each including a primary burner and being arranged preferably vertically in a wall of a closed combustion chamber, the method including the step of supplying fuel and combustion air in stages to the burner flames via supply lines, which are separated from each other and open into the wall in a substantially vertical arrangement, the improvement in combination therewith comprises with a number of said primary burners one arranged above the other the steps of:

feeding coal dust along with its carrier gas, and a stream of mantle air, to the primary burner and generating a primary flame zone having a strong internal back flow region and burning the coal dust under fuel-rich conditions, feeding reduction fuel in the form of coal dust, along with its carrier gas, into the combustion chamber and generating a secondary flame zone in the vicinity of the primary flame zone and being operated under more-fuel-rich conditions than the primary flame zone, and feeding stage air into the combustion chamber and generating a final combustion zone in the vicinity of the secondary flame zone and being operated under fuel lean conditions.

9. A method according to claim 8, wherein the coal dust of said reduction fuel is different in its reactivity to the coal dust fed to the primary burner.

* * * * *